US011112734B2

(12) United States Patent
Kumagai et al.

(10) Patent No.: US 11,112,734 B2
(45) Date of Patent: Sep. 7, 2021

(54) BELT DEVICE, BELT REGULATOR, ROLLER UNIT, AND IMAGE FORMING APPARATUS

(71) Applicants: Naohiro Kumagai, Kanagawa (JP); Masanari Fujita, Tokyo (JP); Katsuya Kawagoe, Kanagawa (JP); Masaharu Furuya, Kanagawa (JP); Hiroki Nakamatsu, Kanagawa (JP); Yoshiki Hozumi, Kanagawa (JP)

(72) Inventors: Naohiro Kumagai, Kanagawa (JP); Masanari Fujita, Tokyo (JP); Katsuya Kawagoe, Kanagawa (JP); Masaharu Furuya, Kanagawa (JP); Hiroki Nakamatsu, Kanagawa (JP); Yoshiki Hozumi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/820,731

(22) Filed: Mar. 17, 2020

(65) Prior Publication Data

US 2020/0301322 A1 Sep. 24, 2020

(30) Foreign Application Priority Data

Mar. 18, 2019 (JP) ..... JP2019-050083
Jan. 10, 2020 (JP) ..... JP2020-002763

(51) Int. Cl.
*G03G 15/16* (2006.01)

(52) U.S. Cl.
CPC ..... *G03G 15/1615* (2013.01)

(58) Field of Classification Search
CPC ..... G03G 15/1615
See application file for complete search history.

(56) References Cited

U.S. PATENT DOCUMENTS 6,078,766 A 6/2000 Kurotaka
8,837,989 B2 * 9/2014 Yasumoto ..... G03G 15/1615 399/165
2012/0234656 A1 9/2012 Yamaoka
2013/0306441 A1 * 11/2013 Asaoka ..... B65G 15/64 198/806

(Continued)

FOREIGN PATENT DOCUMENTS

JP 11-116089 4/1999
JP 2012-198293 10/2012

(Continued)

*Primary Examiner* — Sevan A Aydin
(74) *Attorney, Agent, or Firm* — Xsensus LLP

(57) ABSTRACT

A belt device includes a belt wound around a plurality of rollers, one of the plurality of rollers, and a belt contact member disposed on the one of the plurality of rollers. The belt rotates along with the plurality of rollers. The belt contact member faces an edge of the belt in an axial direction of the one of the plurality of rollers and includes a flat portion and a separation portion. The flat portion forms a plane perpendicular to the axial direction of the one of the plurality of rollers. The separation portion is disposed outboard of the flat portion in a radial direction of the one of the plurality of rollers and has a surface located farther from the edge of the belt than the flat portion in the axial direction of the one of the plurality of rollers.

10 Claims, 7 Drawing Sheets

(56) References Cited

U.S. PATENT DOCUMENTS

| | | | | |
|---|---|---|---|---|
| 2014/0008184 | A1 | 1/2014 | Hozumi et al. | |
| 2014/0083821 | A1 | 3/2014 | Hozumi et al. | |
| 2014/0183007 | A1 | 7/2014 | Hozumi et al. | |
| 2014/0209437 | A1 | 7/2014 | Hozumi et al. | |
| 2015/0117914 | A1 | 4/2015 | Hozumi et al. | |
| 2015/0125189 | A1 | 5/2015 | Hozumi et al. | |
| 2015/0227089 | A1 | 8/2015 | Hozumi et al. | |
| 2015/0301484 | A1 | 10/2015 | Hozumi et al. | |
| 2015/0314976 | A1 | 11/2015 | Hozumi et al. | |
| 2016/0139553 | A1* | 5/2016 | Hozumi ..... | B65H 29/16<br>399/388 |
| 2016/0251166 | A1 | 9/2016 | Hozumi et al. | |
| 2017/0242387 | A1 | 8/2017 | Hozumi et al. | |
| 2018/0120739 | A1 | 5/2018 | Hozumi | |
| 2018/0267437 | A1 | 9/2018 | Hozumi | |

FOREIGN PATENT DOCUMENTS

| | | |
|---|---|---|
| JP | 2014-010429 | 1/2014 |
| JP | 2014-095737 | 5/2014 |

* cited by examiner

BELT DEVICE, BELT REGULATOR, ROLLER UNIT, AND IMAGE FORMING APPARATUS

CROSS-REFERENCE TO RELATED APPLICATIONS

This patent application is based on and claims priority pursuant to 35 U.S.C. § 119(a) to Japanese Patent Application Nos. 2019-050083, filed on Mar. 18, 2019 and 2020-002763, filed on Jan. 10, 2020, in the Japan Patent Office, the entire disclosure of each of which is hereby incorporated by reference herein.

BACKGROUND

Technical Field

Embodiments of the present disclosure relate to a belt device, a belt regulator, a roller unit, and an image forming apparatus.

Description of the Related Art

A certain belt device includes a belt wound around a roller and a belt contact member disposed at an end of the roller to contact the belt.

SUMMARY

Embodiments of the present disclosure describe an improved belt device that includes a belt wound around a plurality of rollers, one of the plurality of rollers, and a belt contact member disposed on the one of the plurality of rollers. The belt rotates along with the plurality of rollers. The belt contact member faces an edge of the belt in an axial direction of the one of the plurality of rollers and includes a flat portion and a separation portion. The flat portion forms a plane perpendicular to the axial direction of the one of the plurality of rollers. The separation portion is disposed outboard of the flat portion in a radial direction of the one of the plurality of rollers and has a surface located farther from the edge of the belt than the flat portion in the axial direction of the one of the plurality of rollers.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
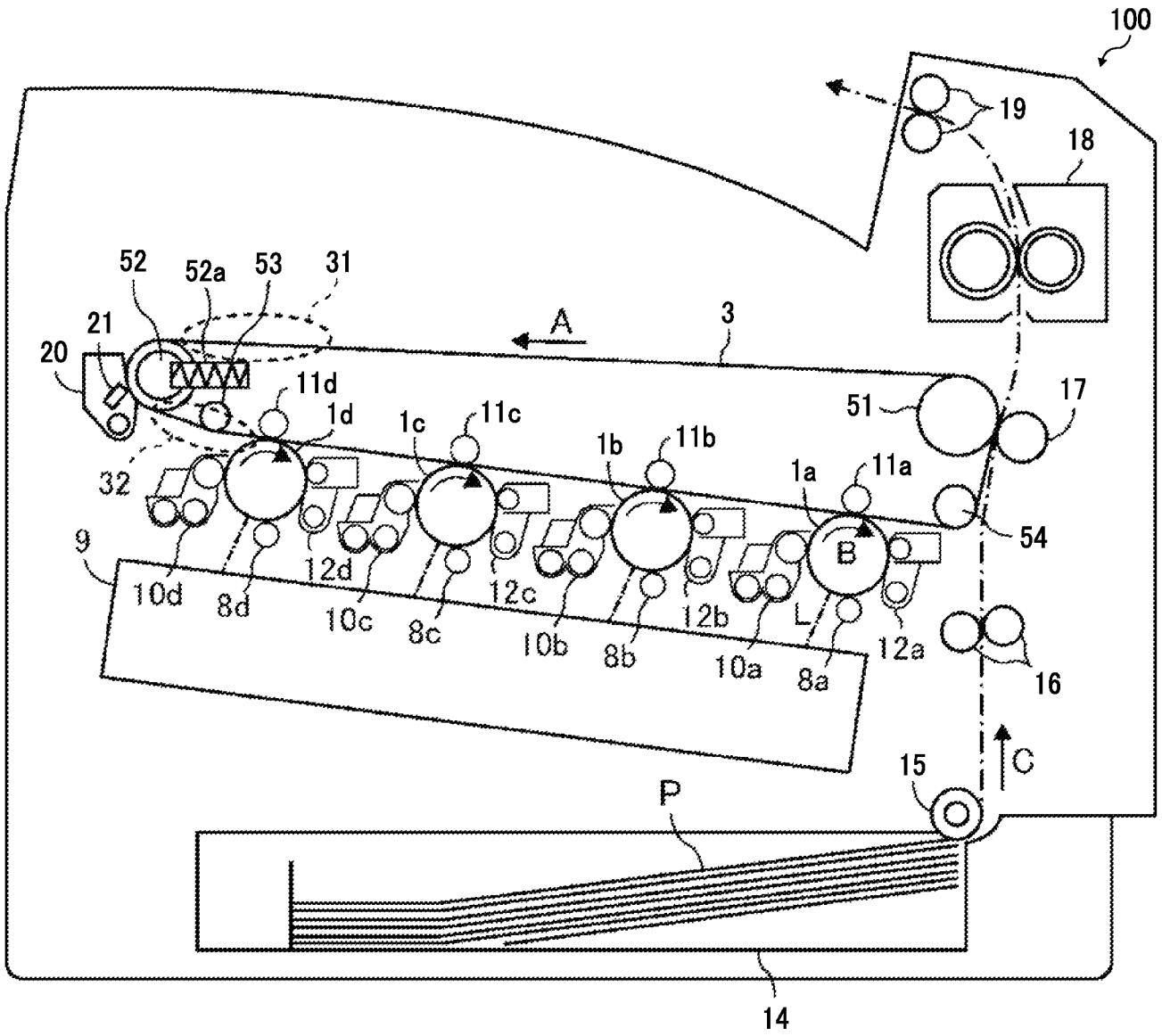
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

Embodiments of the present disclosure are described below.

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

FIG. 1 is a schematic view illustrating a configuration of an example of an image forming apparatus 100, which is a printer in the present embodiment. The image forming apparatus 100 illustrated in FIG. 1 includes first to fourth photoconductors 1*a*, 1*b*, 1*c*, and 1*d* disposed in a housing of the image forming apparatus 100. The image forming apparatus 100 further includes four charging devices 8*a*, 8*b*, 8*c*, and 8*d*, four developing devices 10*a*, 10*b*, 10*c*, and 10*d*, four transfer rollers 11*a*, 11*b*, 11*c*, and 11*d*, and four cleaning devices 12*a*, 12*b*, 12*c*, and 12*d*. Toner images of different colors (i.e., black, magenta, cyan, and yellow toner images) are formed on the photoconductors 1*a*, 1*b*, 1*c*, and 1*d*, respectively.

An intermediate transfer belt 3 as an intermediate transferor is opposed to the first to fourth photoconductors 1*a*, 1*b*, 1*c*, and 1*d*, and each of the photoconductors 1*a*, 1*b*, 1*c*, and 1*d* contacts the surface of the intermediate transfer belt 3. The intermediate transfer belt 3 is wound around a plurality of rollers including a drive roller 51 and support rollers 52, 53, and 54. The broken-line circles in FIG. 1 indicate a portion 31 of the intermediate transfer belt 3 between the support roller 52 and the drive roller 51, and a portion 32 of the intermediate transfer belt 3 between the support roller 52 and the support roller 53. Any one of the drive roller 51 and the support rollers 52, 53, and 54 is also referred to as, simply, "roller", unless distinguished.

A belt tension spring 52*a* is disposed near the support roller 52. The belt tension spring 52*a* applies elastic force to the support roller 52 in the direction away from the drive roller 51 and the support roller 53. Thus, the intermediate transfer belt 3 entrained around the support roller 52 and other rollers is tensioned without slack to effect good transport of a sheet P. Note that the belt tension spring 52*a* is, for example, a spring, a flat spring, rubber, or the like.

As the drive roller 51 is rotated by a driving source, the intermediate transfer belt 3 rotates in the direction indicated by arrow A in FIG. 1. The intermediate transfer belt 3 is either a multi-layer belt or a single-layer belt. In the case of the multi-layer belt, the intermediate transfer belt 3 preferably includes a base layer formed of a material, such as fluoroplastic, polyvinylidene fluoride (PVDF) sheet, or polyimide (PI) resin, that is less elastic, and a smooth coat layer formed of, for example, fluoroplastic that covers the surface of the intermediate transfer belt 3. In the case of the single-layer belt, the intermediate transfer belt 3 is preferably made of, for example, PVDF, polycarbonate (PC), PI, or the like.

Regardless of the color of toner, the configuration and operation to form toner images on the photoconductors 1*a*, 1*b*, 1*c*, and 1*d* are the same. Similarly, the configuration and operation to transfer the toner images from the photoconductors 1*a*, 1*b*, 1*c*, and 1*d* onto the intermediate transfer belt 3 are the same, differing only in the color of toner employed. Accordingly, only a description is given of the configuration and operation to form black toner images on the first photoconductor 1*a* and transfer the black toner images onto the intermediate transfer belt 3, as representative, with a description of the configuration and operation to form toner images on the second to fourth photoconductors 1*b*, 1*c*, and 1*d* omitted to avoid redundancy.

The photoconductor 1*a* is driven to rotate in the direction indicated by arrow B in FIG. 1. A discharger irradiates the surface of the photoconductor 1*a* with light to an initial surface potential of the photoconductor 1*a*. A charging device 8*a* is disposed near the photoconductor 1*a* and uniformly charges the initialized surface of the photoconductor 1*a* to a negative polarity. Subsequently, an exposure device 9 irradiates the charged surface of the photoconductor 1*a* with a modulated laser beam L, thereby forming an electrostatic latent image corresponding to image data on the surface of the photoconductor 1*a*. In the image forming apparatus 100 according to the present embodiment, the exposure device 9 includes a laser emission device that emits the laser beam L.

A developing device 10*a* is disposed near the photoconductor 1*a*. When the electrostatic latent image on the photoconductor 1*a* passes a developing device 10, the electrostatic latent image is developed with black toner into a visible image. A transfer roller 11*a* is disposed opposite the photoconductor 1*a* via the intermediate transfer belt 3.

A positive transfer voltage in polarity opposite the charges of the toner image formed on the photoconductor 1*a* is applied to the transfer roller 11*a*. Thus, a transfer electric field is generated between the photoconductor 1*a* and the intermediate transfer belt 3, and the toner image on the photoconductor 1*a* is electrostatically transferred onto the intermediate transfer belt 3 that rotates in synchronization with the photoconductor 1*a*. After the toner image is transferred onto the intermediate transfer belt 3, the cleaning device 12*a* removes any residual toner adhering to the surface of the photoconductor 1*a* and cleans the surface of the photoconductor 1*a*.

Similarly, magenta toner images, cyan toner images, and yellow toner images are formed on the second to fourth photoconductors 1*b*, 1*c*, and 1*d*, respectively. Then, the toner images of respective colors are sequentially transferred to and superimposed on the intermediate transfer belt 3 in order of yellow, cyan, magenta, and black, thereby forming a composite toner image.

A sheet feeder 14 is disposed at the bottom of the image forming apparatus 100, and a sheet feeding roller 15 rotates to feed a recording medium P in the direction indicated by arrow C in FIG. 1. A registration roller pair 16 feeds the recording medium P between the drive roller 51 and a secondary transfer roller 17 disposed opposite the drive roller 51. At that time, the secondary transfer roller 17 is supplied with a predetermined transfer voltage to secondarily transfer the composite toner image from the intermediate transfer belt 3 onto the recording medium P.

The recording medium P on which the composite toner image has been transferred is further transported upward and passes through a fixing device 18. When the recording medium P passes through the fixing device 18, the fixing device 18 fixes the composite toner image on the recording medium P with heat and pressure. After the recording medium P passes through the fixing device 18, the recording medium P is ejected outside the image forming apparatus 100 through an output roller pair 19 of a sheet ejection section.

After the composite toner image is transferred onto the recording medium P, a belt cleaning device 20 removes residual toner adhering to the intermediate transfer belt 3. In the present embodiment, the belt cleaning device 20 includes a cleaning blade 21 made of, for example, urethane. The cleaning blade 21 contacts the intermediate transfer belt 3 to scrape off the residual toner. The belt cleaning device 20 is not limited to the structure described above but can be selected from various cleaning types. For example, a belt cleaning device including a conductive fur brush to electrostatically clean the intermediate transfer belt 3 can be used.

Next, a description is given of a belt regulator according to the present embodiment to control movement of the intermediate transfer belt 3 in the axial direction of the plurality of rollers. The belt regulator according to the present embodiment is disposed at least on one of the plurality of rollers in the image forming apparatus 100 illustrated in FIG. 1. In the following description, the intermediate transfer belt 3 is simply referred to as a "belt 3".

Figure 2A:
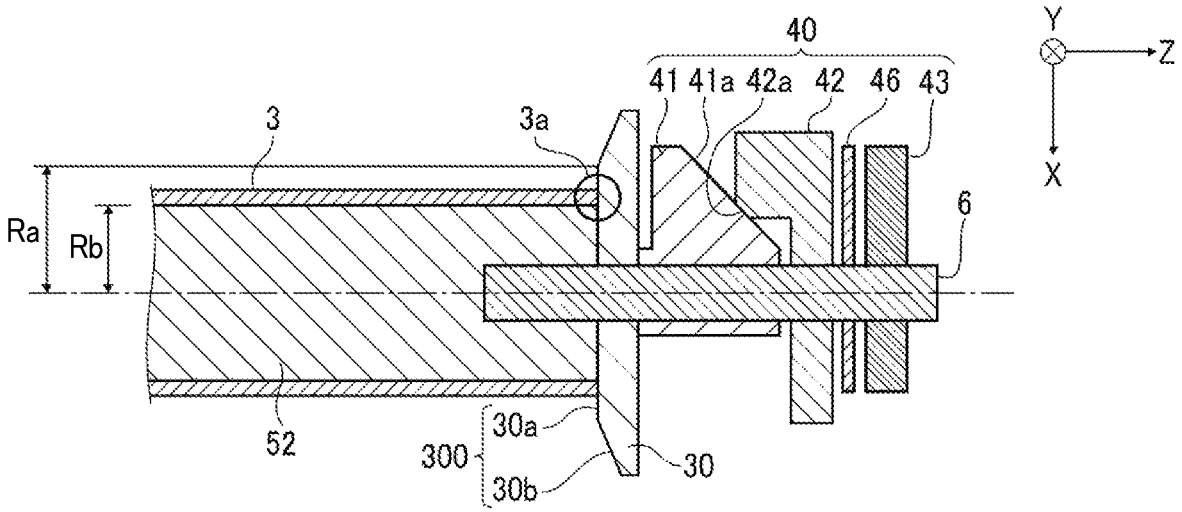
FIGS. 2A and 2B are schematic views of a belt regulator according to an embodiment of the present disclosure.

In the present embodiment, a main portion of the belt regulator is disposed at one end of the support roller 52 in the image forming apparatus 100 illustrated in FIG. 1. Therefore, FIGS. 2A and 2B and subsequent figures depict one side of the support roller 52. FIG. 2A is a schematic cross-sectional view of the belt regulator according to the present embodiment.

As illustrated in FIG. 2A, the belt regulator includes a roller shaft 6 having an axis of rotation coaxial with the support roller 52 at the end of the support roller 52. The roller shaft 6 has a columnar shape having a diameter smaller than that of the support roller 52. The roller shaft 6 traverses the support roller 52, a belt contact member 30, and a shaft displacement member 41 and a roller shaft support 43 of a belt position correction unit 40, which are included in the belt regulator, to be described later. The roller shaft 6 is formed together with the support roller 52 as a single piece and penetrates the roller shaft support 43. Here, a belt device includes the support roller 52, the roller shaft 6, the belt 3, and the belt contact member 30.

The belt contact member 30 is disposed at the end of the support roller 52 and movable in an axial direction of the roller shaft 6 (or the support roller 52) that is the Z direction in FIG. 2A. As an edge (belt edge 3*a*) of the belt 3 contacts the belt contact member 30, the belt contact member 30 moves in the axial direction of the roller shaft 6. The belt contact member 30 is disposed either at one end of the belt 3 or at both ends of the belt 3 in the axial direction of the roller shaft 6.

The belt contact member 30 is made of a material softer than that of the belt 3. Accordingly, even when the belt edge 3*a* contacts the belt contact member 30, the belt edge 3*a* is not damaged thereby. Therefore, this configuration does not adversely affect either the behavior of the belt 3 or images formed on the belt 3.

The belt contact member 30 includes a belt opposed face 300 facing the belt edge 3*a*. The belt opposed face 300 includes a flat portion 30*a* and a separation portion 30*b*. The flat portion 30*a* forms a plane substantially perpendicular to the axial direction of the roller shaft 6. The separation portion 30*b* is disposed outboard of the flat portion 30*a* in the radial direction of the support roller 52 (i.e., the X direction in FIG. 2A). A surface of the separation portion 30*b* is located farther from the belt edge 3*a* than the flat portion 30*a* in the axial direction of the roller shaft 6.

The periphery of the flat portion 30*a* forms a circle concentric with the axis of the support roller 52. The flat portion 30*a* serves as a belt edge contact portion where the belt edge 3*a* contacts when the intermediate transfer belt 3 moves outward in the axial direction of the roller shaft 6 (i.e., the direction from the center toward the end of the support roller 52).

As illustrated in FIG. 2A, a radius Ra of the circular periphery of the flat portion 30*a* is larger than a combined length of a radius Rb of the support roller 52 plus a thickness of the belt 3 so as to prevent the belt 3 from becoming stranded on the belt contact member 30 and coming off the support roller 52 when the belt edge 3*a* moves and contacts the flat portion 30*a*. When the radius Rb of the support roller 52 is 8.78 mm, and the thickness of the belt 3 is 80 μm, the radius Ra of the circular periphery of the flat portion 30*a* of the belt contact member 30 is larger than 8.86 mm, for example, the radius Ra is 9.00 mm so that the belt edge 3*a* does not interfere other components.

The flat portion 30*a* is only required to function as the belt edge contact portion, and therefore the shape of the periphery is not limited to circle but may be a rectangle, a polygon, or any other closed curve. In this case, a distance, which corresponds to the radius Ra, from the center of the support roller 52 to the periphery of the rectangle or the like is to be larger than the combined length of the radius Rb of the support roller 52 plus the thickness of the belt 3.

The belt contact member 30 is not secured to the support roller 52 and the roller shaft 6, and is freely rotatable coaxially with the axis of the support roller 52 in the X-Y plane illustrated in FIG. 2A. For this reason, when the belt 3 rotates while contacting the flat portion 30*a*, the belt contact member 30 is driven to rotate along with the belt 3 by friction between the belt edge 3*a* and the flat portion 30*a*.

Figure 2B:
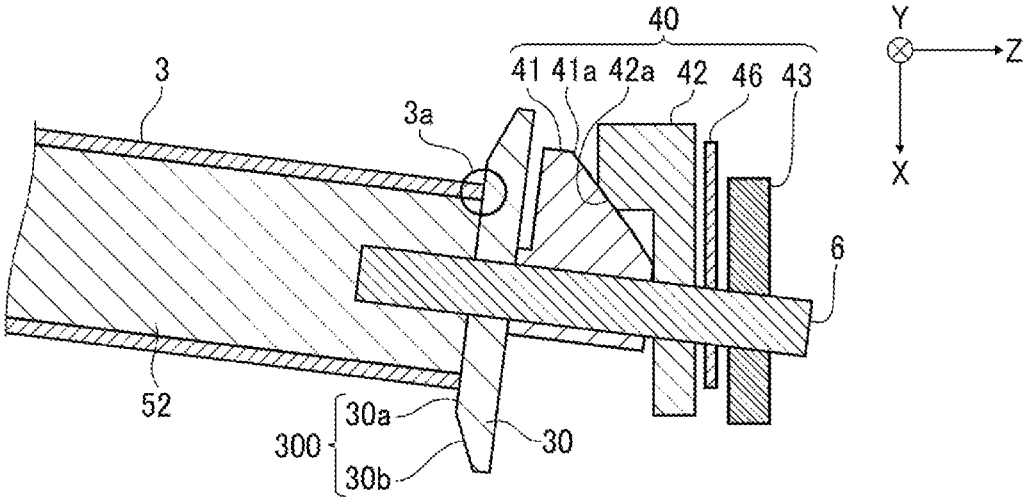
Figure 3A:
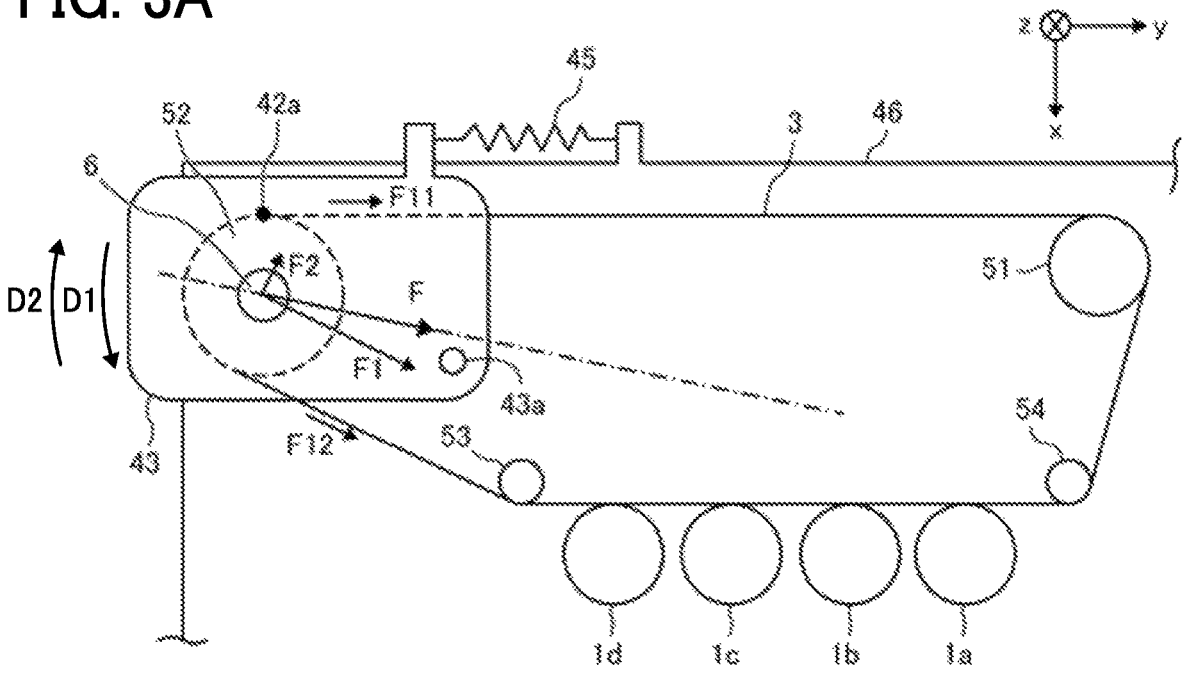
FIGS. 3A and 3B are schematic views of the belt regulator according to an embodiment of the present disclosure.
Figure 3B:
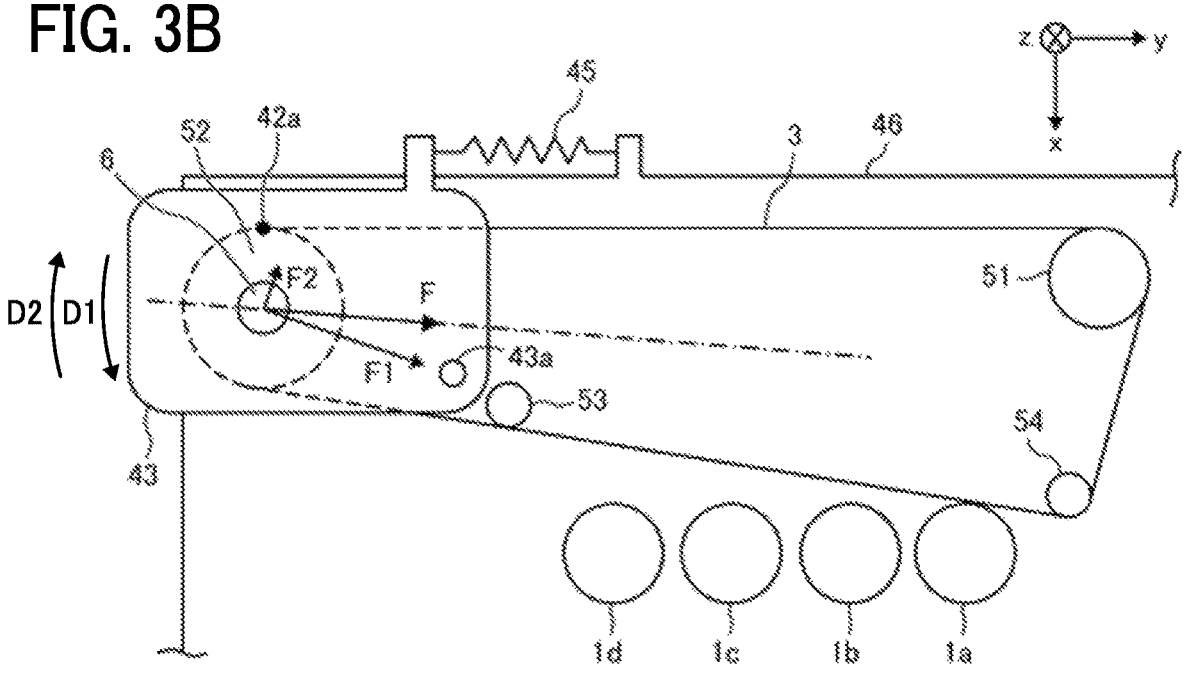

A description is given below of the belt position correction unit 40 with reference to FIGS. 2A to 3B. The belt position correction unit 40 returns the belt 3 to the original position when the belt 3 moves in the axial direction of the roller shaft 6. FIG. 2B is a schematic view illustrating a state in which the support roller 52 and the roller shaft 6 illustrated in FIG. 2A are inclined. FIGS. 3A and 3B are schematic views of the belt regulator illustrated in FIG. 2A as viewed in the Z direction.

The belt position correction unit 40 includes the shaft displacement member 41, a shaft guide 42, the roller shaft support 43, and a stationary portion 46 illustrated in FIG. 2A, and a roller shaft support spring 45 illustrated in FIG. 3A. An inward face of the shaft displacement member 41 in the axial direction of the roller shaft 6 contacts the belt contact member 30. As the belt edge 3*a* contacts the belt contact member 30, the belt contact member 30 moves outward in the axial direction of the roller shaft 6. As a result, the shaft displacement member 41 is pressed by the belt contact member 30 and moves outward in the axial direction of the roller shaft 6. The shaft displacement member 41 has an inclined face 41*a* on the outside in the axial direction of the roller shaft 6. The inclined face 41*a* is a flat surface angled outward in the axial direction of the roller shaft 6 and inclined with respect to the surface of the belt 3. Since the above-described roller shaft 6 traverses the shaft displacement member 41, the roller shaft 6 is moved along with the shaft displacement member 41 that moves in the X direction as illustrated in FIG. 2B.

As illustrated in FIG. 2A, a contact portion 42*a* of the shaft guide 42 contacts the inclined face 41*a* of the shaft displacement member 41. Even if the roller shaft 6 and the shaft displacement member 41 move, the shaft guide 42 is secured so as not to move. With this configuration, as the shaft displacement member 41 moves outward in the axial direction of the roller shaft 6, the relative position at which the contact portion 42*a* contacts the inclined face 41*a* rises along the inclined face 41*a*. As a result, the shaft displacement member 41 is displaced downward in the X direction and the roller shaft 6 penetrating through the shaft displacement member 41 are inclined as illustrated in FIG. 2B.

The shaft guide 42 is secured to the stationary portion 46 disposed outboard of the shaft guide 42 in the axial direction of the roller shaft 6, and the roller shaft support 43 is disposed outboard of the stationary portion 46 in the axial direction of the roller shaft 6. A detailed description is given later of the roller shaft support 43 and the stationary portion 46 with reference to FIGS. 3A and 3B.

As illustrated in FIG. 2A, the roller shaft 6 penetrates the roller shaft support 43. Accordingly, when the end of the roller shaft 6 is displaced downward in the X direction together with the shaft displacement member 41, and the roller shaft 6 is inclined, the roller shaft support 43 is rotated around a support center 43*a* in the direction indicated by arrow D1 in FIG. 3A and inclined. The roller shaft support spring 45 couples the roller shaft support 43 to the stationary portion 46 that does not move with the movement of the roller shaft 6. The roller shaft support spring 45 is an example of an elastic body, and a flat spring, rubber, or the like may be used instead of the roller shaft support spring 45.

Among the above-described components, the support roller 52, the roller shaft 6, the belt contact member 30, and the belt position correction unit 40 constitute a roller unit. Further, the roller shaft 6 and the roller shaft support 43 constitute a shaft displacement member holder.

Next, a description is given of operation of the belt regulator of the image forming apparatus 100 according to the present embodiment.

As the drive roller 51 of the image forming apparatus 100 is rotated by the driving source, the belt 3 travels along with the drive roller 51 in the Y direction in FIG. 2A (hereinafter referred to as a "direction of travel"). As a result, the support roller 52 around which the belt 3 is wound rotates along with the belt 3. At that time, the belt 3 may move in the axial direction of the roller shaft 6 due to, for example, the fact that the plurality of rollers is not parallel to each other. As the belt 3 moves outward in the axial direction of the roller shaft 6, the belt edge 3*a* contacts the flat portion 30*a* of the belt contact member 30, and the belt 3 rotates in the direction of travel while the belt edge 3*a* contacts the flat portion 30*a*.

Further, as the belt edge 3*a* contacts the belt contact member 30, the belt contact member 30 moves outward in the axial direction of the roller shaft 6. As a result, the shaft displacement member 41 receives an outward force in the axial direction of the roller shaft 6. With this outward force, as the shaft displacement member 41 moves outward in the axial direction of the roller shaft 6, the relative position at which the contact portion 42*a* of the shaft guide 42 contacts the inclined face 41*a* rises along the inclined face 41*a* as illustrated in FIG. 2B. Therefore, the roller shaft 6 penetrating through the shaft displacement member 41 is inclined while the shaft displacement member 41 is displaced downward in the X direction.

A detailed description is given of the movement of the belt 3 wound around the plurality of rollers in the axial direction of the roller shaft 6. Here, for ease of description, the movement of the portion of the belt 3 wound around the support rollers 52 and 53 is described.

As the belt 3 moves in the axial direction of the roller shaft 6 and contacts the belt contact member 30, the shaft displacement member 41 moves outward in the axial direction of the roller shaft 6, and the roller shaft 6 and the support roller 52 are inclined. This movement is described in detail below.

As illustrated in FIG. 2A, as the belt edge 3*a* contacts the flat portion 30*a* of the belt contact member 30, the belt contact member 30 moves outward in the axial direction of the roller shaft 6. The shaft displacement member 41 contacts an outward face of the belt contact member 30 in the axial direction of the roller shaft 6. Accordingly, the shaft displacement member 41 receives an outward force in the axial direction of the roller shaft 6 due to the movement of the belt contact member 30. With this outward force, as the shaft displacement member 41 moves outward in the axial direction of the roller shaft 6, the relative position at which the contact portion 42*a* contacts the inclined face 41*a* rises along the inclined face 41*a*. As a result, the shaft displacement member 41 is displaced downward in the X direction as illustrated in FIG. 2B. Therefore, the end of the roller shaft 6, which penetrates through the shaft displacement member 41, moves downward in the positive X direction in FIG. 2B along with the shaft displacement member 41.

As the end of the roller shaft 6 moves in the positive X direction, the support roller 52 through which the roller shaft 6 traverses is inclined. When the support roller 52 is inclined more than the inclination of the support roller 53, the support rollers 52 and 53 receive force to form a relatively opposite inclination due to the tension of the belt 3. When the support rollers 52 and 53 form the relatively opposite inclination, the belt 3 moves in the negative Z direction and returns to the original position.

To correct the position of the belt 3, the inclined face 41*a* of the shaft displacement member 41 is required to contact the contact portion 42*a* of the shaft guide 42 as described above. Here, a description is given of the principle that the shaft displacement member 41 receives force directed toward the shaft guide 42 so that the shaft displacement member 41 contacts the shaft guide 42.

As illustrated in FIG. 3A, tension F11 and tension F12 are generated on the belt 3 wound around the support roller 52. Therefore, the resultant force F of the tension F11 and the tension F12 is applied to the support roller 52. As a result, the resultant force F is applied to the roller shaft support 43 via the roller shaft 6. The roller shaft support 43 is freely rotatable around the support center 43*a*. The support center 43*a* is disposed on the side opposite the contact portion 42*a* with respect to the direction in which the resultant force F acts on the support roller 52. Here, F1 and F2 represent components of the resultant force F. Therefore, the rotation moment F2 is applied to the roller shaft support 43 such that the shaft displacement member 41 approaches the contact portion 42*a* because the shaft displacement member 41 moves along with the roller shaft support 43 and the roller shaft 6. That is, force is applied to the roller shaft 6 penetrating through the roller shaft support 43 and the shaft displacement member 41 through which the roller shaft 6 penetrates such that the shaft displacement member 41 approaches the contact portion 42*a*. As a result, the shaft displacement member 41 can retain the contact with the contact portion 42*a* of the shaft guide 42.

In the image forming apparatus 100 according to the present embodiment, as the position of the roller around which the belt 3 is wound changes, the rotation moment F2 applied to the roller shaft support 43 changes. Specifically, for example, when an image is formed in a monochrome mode using only black toner, the belt 3 is looped around the plurality of rollers so that only the photoconductor 1*a* for black toner contacts the belt 3 and the photoconductors 1*b*, 1*c*, and 1*d* for magenta, cyan, and yellow toners do not contact the belt 3 as illustrated in FIG. 3B. On the other hand, when an image is formed in a full-color mode using all toners of black, magenta, cyan, and yellow, the belt 3 is looped around the plurality of rollers so that the photoconductors 1*a*, 1*b*, 1*c*, and 1*d* contact the belt 3 as illustrated in FIG. 3A. As a result, the angle of the belt 3 wound around the support roller 52 is different between the monochrome mode illustrated in FIG. 3B and the full-color mode illustrated in FIG. 3A. Therefore, tension applied to the roller shaft support 43 is different in direction.

A description is given of the belt regulator in the case in which the support center 43*a* of the roller shaft support 43 is located at a position shifted upward compared with the case illustrated in FIGS. 3A and 3B.

In this case, the rotation moment F2 is applied to the roller shaft support 43 in the monochrome mode such that the shaft displacement member 41 approaches the contact portion 42*a* as described above. On the other hand, the rotation moment F2 is applied to the roller shaft support 43 in the full-color mode such that the shaft displacement member 41 moves away from the contact portion 42*a* because the support center 43*a* of the roller shaft support 43 is located on the same side as the contact portion 42*a* with respect to the direction in which the resultant force F acts on the support roller 52. That is, in the full-color mode, the shaft displacement member 41 is separated from the contact portion 42*a* of the shaft guide 42.

To solve such a problem, as illustrated in FIGS. 3A and 3B, when the image forming apparatus 100 operates in both of the full-color mode and the monochromatic mode, the support center 43*a* is located on the side opposite the contact portion 42*a* with respect to the direction of the resultant force F of the tensions F11 and F12, that is, the direction of the resultant force F acting on the axis of the support roller 52. In image forming apparatuses, as illustrated in FIG. 1, tension generated on the portion 31 of the belt 3 traveling between the support roller 52 and the drive roller 51 is the same as tension generated on the portion 32 of the belt 3 traveling between the support roller 52 and the support roller 53. Therefore, a straight line from the force point of the resultant force F in the direction of the resultant force F is a bisector that bisects an angle formed by the portion 31 of the belt 3 and the portion 32 of the belt 3.

In the present embodiment, the support center 43*a* is located in consideration of the above-described factors. Accordingly, force can be applied to the roller shaft support 43 such that the shaft displacement member 41 approaches the contact portion 42*a* even if the relative positions of the plurality of rollers changes due to, for example, the switch between the monochrome mode and the full-color mode. As a result, the roller shaft 6 can be reliably inclined.

Further, in the present embodiment, the roller shaft support spring 45 is provided as illustrated in FIG. 3A. Accordingly, when the shaft displacement member 41 is pressed outward in the axial direction of the roller shaft 6 and the roller shaft 6 is inclined, the roller shaft support 43 is rotated around the support center 43*a* in the direction indicated by arrow D1 in FIG. 3A and inclined, thereby stretching the roller shaft support spring 45. The stretched roller shaft support spring 45 applies elastic force to the roller shaft support 43. This elastic force urges the roller shaft support 43 to return to the original position in the direction indicated by the arrow D2, and the roller shaft 6 penetrating through the roller shaft support 43 tries to be displaced upward. For this reason, when the shaft displacement member 41 is pressed outward in the axial direction of the roller shaft 6 as described above, the shaft displacement member 41 does not separate from the shaft guide 42, and the inclined face 41*a* of the shaft displacement member 41 can retain the contact with the contact portion 42*a* of the shaft guide 42 due to the elastic force of the roller shaft support spring 45 and the tension of the belt 3.

In the present embodiment, as illustrated in FIG. 2A, the shaft displacement member 41 is disposed below the shaft guide 42 so as to contact the shaft guide 42. As described above, force to press the shaft displacement member 41 toward contact portion 42*a* is required to keep the shaft displacement member 41 in contact with the contact portion 42*a* of the shaft guide 42.

Figure 4A:
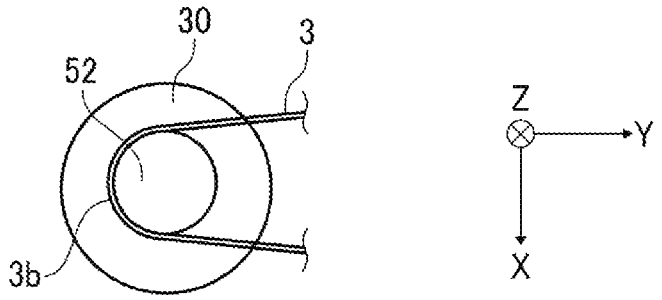
FIGS. 4A to 4C are cross-sectional views of the belt regulator illustrated in FIGS. 2A and 2B along the X-Y plane.
Figure 4B:
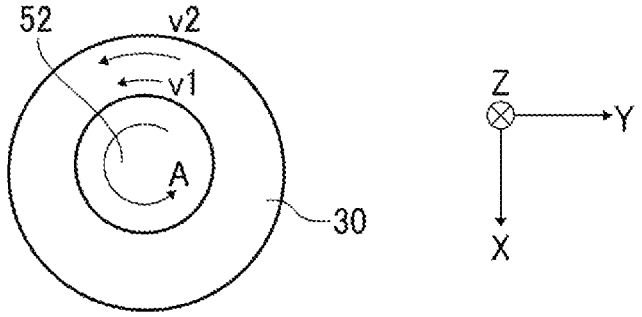
Figure 4C:
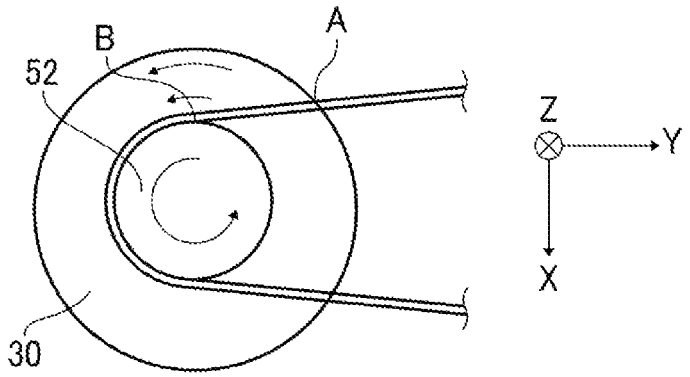

FIGS. 4A to 4C are cross-sectional views of the belt regulator illustrated in FIG. 2A along the X-Y plane.

In FIG. 4A, a portion 3*b* of the belt 3 wound around the support roller 52 rotates at the same linear velocity as that of the belt contact member 30.

FIG. 4B is a cross-sectional view illustrating the linear velocity of the belt contact member 30 when the support roller 52 rotates in the direction indicated by arrow A in FIG. 4B. In FIG. 4B, v1 represents the linear velocity on the side close to the rotation center of the belt contact member 30 in the radial direction of the support roller 52, and v2 represents the linear velocity on the side farther from the rotation center of the belt contact member 30 in the radial direction of the support roller 52. The linear velocity v2 is higher than the linear velocity v1.

In FIG. 4C, a point A indicates a position where the belt 3 and the outer periphery of the belt contact member 30 intersect in the axial direction of the roller shaft 6 of the support roller 52, and a point B indicates the contact point where the belt 3 contacts the outer circumference of the support roller 52. At the point B, as illustrated in FIG. 4A, there is no difference in linear velocity between the belt contact member 30 and the belt 3. At the point A, as illustrated in FIG. 4B, the linear velocity of the belt contact member 30 is higher than that at the point B. Therefore, at the point A, the difference in linear velocity occurs between the belt contact member 30 and the belt 3. Since the belt edge 3*a* contacts the belt opposed face 300 as illustrated in FIGS. 2A and 2B, the belt opposed face 300 is likely to be worn out. As the distance between the point A and the point B lengthens, the difference in linear velocity between the belt contact member 30 and the belt 3 increases at the point A, and the belt opposed face 300 is more likely to be worn out.

Figure 5A:
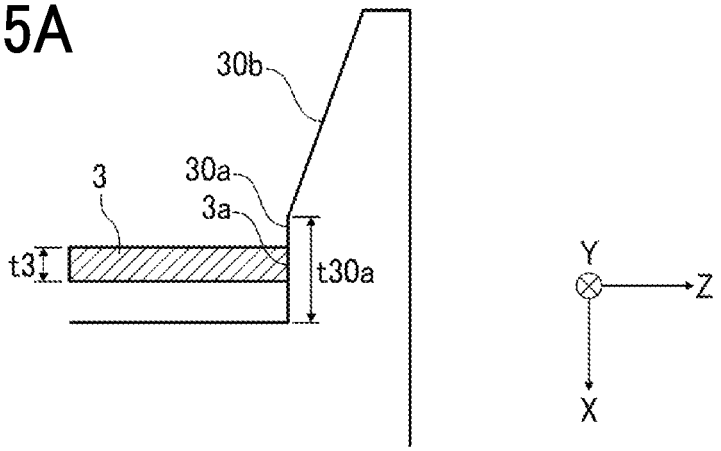
FIGS. 5A to 5C are schematic views illustrating a belt contact member of the belt regulator according to an embodiment of the present disclosure.
Figure 5B:
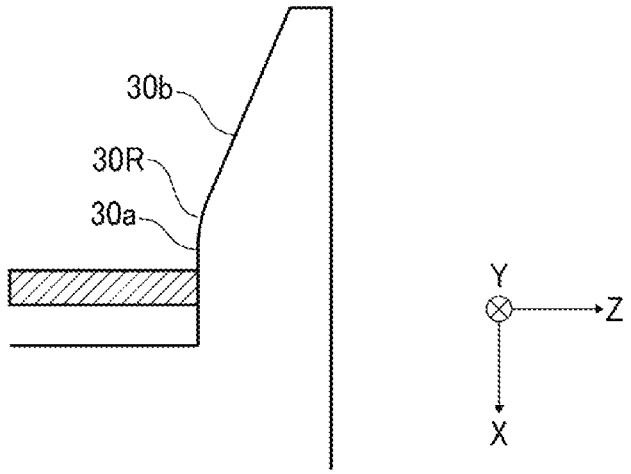
Figure 5C:
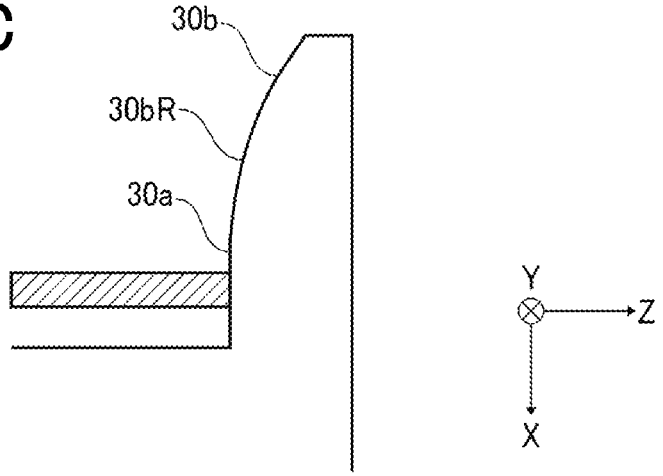

FIGS. 5A to 5C are schematic views illustrating the belt contact member 30 of the belt regulator according to the present embodiment.

In FIG. 5A, the outer periphery of the separation portion 30*b* corresponds to the point A in FIG. 4C. However, as described with reference to FIG. 2A, the surface of the separation portion 30*b* is located farther from the belt edge 3*a* than the flat portion 30*a* in the axial direction of the roller shaft 6. Therefore, the separation portion 30*b* does not contact the belt edge 3*a* and the belt 3 is not worn out even if there is the difference in linear velocity between the belt contact member 30 and the belt 3.

The separation portion 30*b* has an inclined surface that intersects the radial direction of the support roller 52 and the axial direction of the roller shaft 6.

If it were only necessary to eliminate the difference in linear velocity between the belt contact member 30 and the belt edge 3*a*, the configuration in which the entire surface of the belt opposed face 300 is formed with an inclined surface such as the separation portion 30*b* could eliminate the difference in linear velocity. However, with such a configuration, the belt opposed face 300 contacts the ridge line of the belt edge 3*a*. As a result, the inclined surface of the belt opposed face 300 is likely to be worn out.

That is, in the present embodiment, the belt opposed face 300 of the belt contact member 30 includes the flat portion 30*a* and the separation portion 30*b*. The flat portion 30*a* has the plane perpendicular to the axial direction of the roller shaft 6. The separation portion 30*b* is disposed outboard of the flat portion 30*a* in the radial direction of the support roller 52. The surface of the separation portion 30*b* is located farther from the belt edge 3*a* than the flat portion 30*a* in the axial direction of the roller shaft 6. With this configuration, the flat portion 30*a* prevents the wear of the belt opposed face 300 of the belt contact member 30 due to the ridge line of the belt edge 3*a*, and the separation portion 30*b* prevents the wear of the belt opposed face 300 of the belt contact member 30 due to the difference in linear velocity between the belt contact member 30 and the belt edge 3*a*.

As illustrated in 5A, the size t30*a* of the flat portion 30*a* is larger than the thickness t3 of the belt 3 in the radial direction of the support roller 52. This configuration prevents the belt edge 3*a* from moving in the radial direction of the support roller 52 and coming off the flat portion 30*a* even if an area of the belt 3 wound around the support roller 52 is small.

Furthermore, since the separation portion 30*b* has the inclined surface, even if the belt edge 3*a* moves in the radial direction of the support roller 52 and comes off the flat portion 30*a*, the belt edge 3*a* is likely to return to the flat portion 30*a* from the separation portion 30*b*.

In FIG. 5B, a boundary 30R between the flat portion 30*a* and the separation portion 30*b* is chamfered (arc shape). In FIG. 5C, the surface of the separation portion 30*b* includes an arc-shaped face 30*b*R.

These configurations allow the belt edge 3*a* to smoothly contact the belt opposed face 300, so that the belt opposed face 300 is less likely to be worn out.

Figure 6:
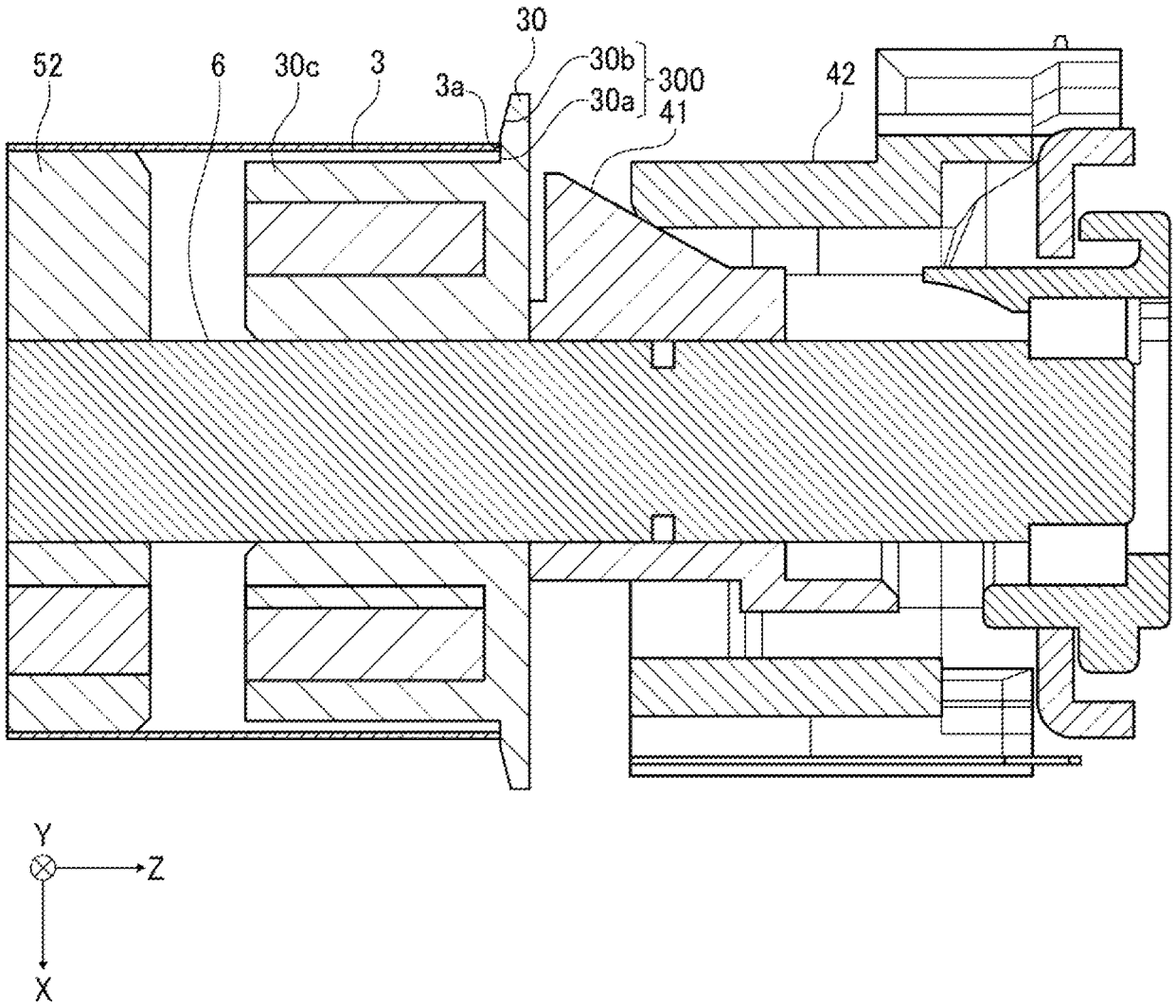
FIG. 6 is a schematic view of a belt regulator according to a variation of the present disclosure.

FIG. 6 is a schematic view of a belt regulator according to a variation of the present disclosure.

In this variation, the belt contact member 30 includes a small-diameter cylindrical portion 30*c* that protrudes inward from the belt opposed face 300 of the belt contact member 30 in the axial direction of the roller shaft 6.

The outer diameter of the small-diameter cylindrical portion 30*c* is slightly smaller than the outer diameter of the support roller 52 to allow the belt contact member 30 to move in the axial direction of the roller shaft 6, and a small space is formed between the outer circumference of the small-diameter cylindrical portion 30*c* and the inner surface of the belt 3 wound around the support roller 52. With this space, when the belt 3 moves, the small-diameter cylindrical portion 30*c* can slidingly support the belt 3.

Figure 7:
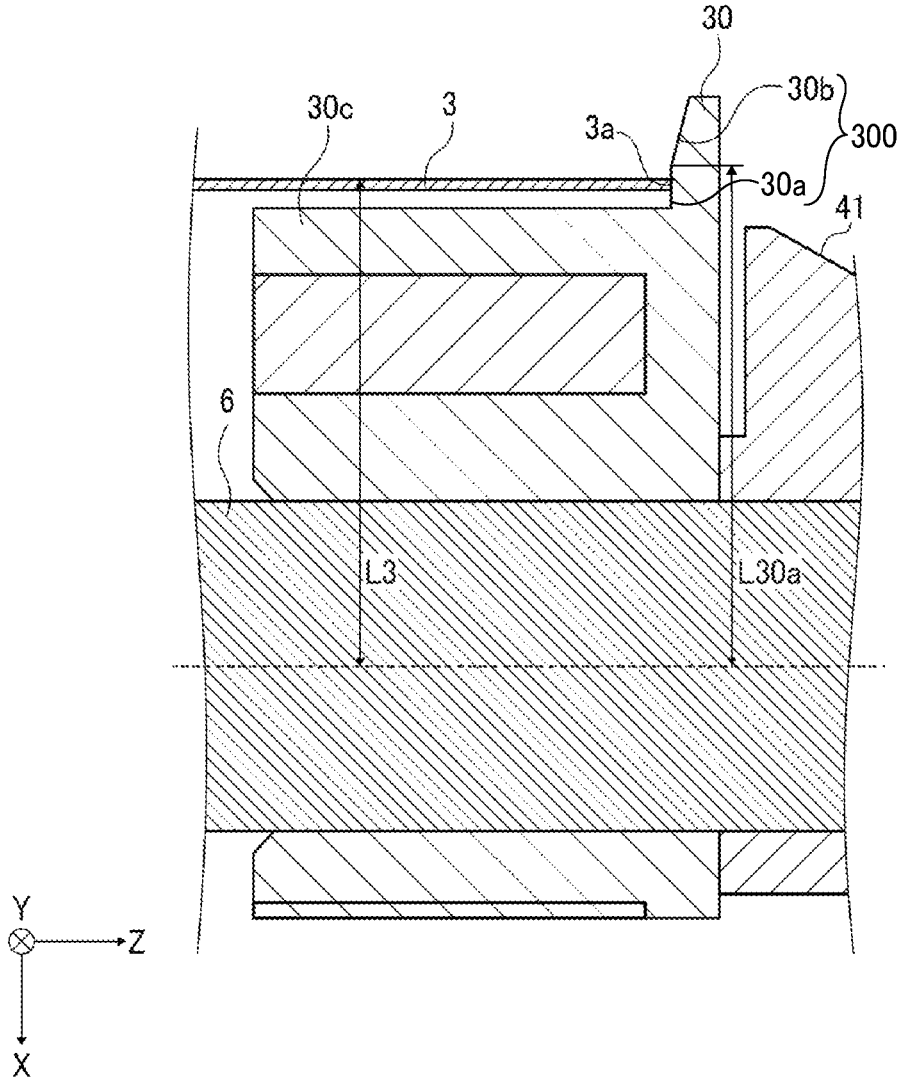
FIG. 7 is an enlarged view of the belt regulator according to the variation illustrated in FIG. 6.

FIG. 7 is an enlarged view of the belt regulator according to the variation illustrated in FIG. 6.

In FIG. 7, in the radial direction of the support roller 52, a distance L30*a* from the axis of the roller shaft 6 to the boundary 30R between the flat portion 30*a* and the separation portion 30*b* is greater than a distance L3 from the axis of the roller shaft 6 to the surface of the belt 3.

That is, the distance L30*a* and the distance L3 each include the small-diameter cylindrical portion 30*c* and the roller shaft 6. Except for this, in the radial direction of the support roller 52, the size of the flat portion 30*a* is greater than a combined length of the thickness of the belt 3 plus the space between the inner surface of the belt 3 and the outer circumference of the small-diameter cylindrical portion 30*c*. Preferably, the size of the flat portion 30*a* is equal to twice the thickness of the belt 3. Further, the relation between the distance L30*a* and the distance L3 is satisfied not only when the belt 3 stops but also when the belt 3 moves.

The belt regulator according to the present embodiment is applicable not only to the intermediate transfer belt 3 but also to a belt that moves in the axial direction (i.e., with which belt crawl occurs) such as a direct transfer belt and a fixing belt.

In the above-described embodiments, the belt regulator is disposed at the end of the support roller 52. However, belt regulators may be disposed at the ends of any two or more rollers among the drive roller 51 and the support rollers 52, 53, and 54.

In the above-described embodiments, a belt regulator may be disposed at both ends of one or more rollers among the drive roller 51 and the support rollers 52, 53, and 54.

In the above-described embodiments, the shaft displacement member 41 has an inclined face 41*a* on the outside in the axial direction of the roller shaft 6. The inclined face 41*a* is a flat surface angled outward in the axial direction of the roller shaft 6, inclined with respect to the surface of the intermediate transfer belt 3, and disposed face-up above the axis of the support roller 52. However, the inclined face 41*a* may be a flat surface ascending at an angle outward in the axial direction of the roller shaft 6, inclined with respect to the surface of the belt 3, and disposed facedown below the axis of the support roller 52.

In the above described embodiments, when the belt 3 travel in the direction of travel while the belt edge 3*a* contacts the flat portion 30*a*, the belt contact member 30 is driven to rotate along with the belt 3 by a frictional force between the belt edge 3*a* and the flat portion 30*a*. As a result, the load applied to the belt edge 3*a* by the frictional force can be reduced, and damage to the belt 3 and wear of the flat portion 30*a* can be prevented.

As a result, according to the present disclosure, a belt device, a belt regulator, a roller unit, and an image forming apparatus that minimize deterioration of a belt contact member facing an edge of a belt can be provided.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A belt device comprising:

a belt wound around a plurality of rollers and to rotate along with the plurality of rollers; and a belt contact member disposed on one of the plurality of rollers and facing an edge of the belt in an axial direction of the one of the plurality of rollers, the belt contact member including:

a flat portion having a plane perpendicular to the axial direction of the one of the plurality of rollers; and a separation portion disposed outboard of the flat portion in a radial direction of the one of the plurality of rollers and having a surface located farther from the edge of the belt than the flat portion in the axial direction of the one of the plurality of rollers, wherein a transition from the flat portion to the separation portion has a continuous derivative.

2. The belt device according to claim 1, wherein a size of the flat portion is larger than a thickness of the belt in the radial direction of the one of the plurality of rollers.

3. The belt device according to claim 1, wherein the surface of the separation portion intersects the radial direction and the axial direction of the one of the plurality of rollers.

4. The belt device according to claim 3, wherein the surface of the separation portion includes an arc-shaped face.

5. A belt regulator comprising:

the belt device according to claim 1;

a shaft displacement member configured to move in the axial direction of the one of the plurality of rollers when the belt moves in the axial direction of the one of the plurality of rollers, the shaft displacement member including an inclined face inclined with respect to a surface of the belt; and a shaft guide disposed opposite the inclined face and being stationary.

6. An image forming apparatus comprising the belt device according to claim 1.

7. The belt device according to claim 1, wherein the surface of the separation portion includes an arc-shaped face.

8. A roller unit, comprising:

a roller; and a belt contact member disposed on the roller and facing an edge of a belt in an axial direction of the roller, the belt wound around a plurality of rollers including the roller, the belt contact member including:

a flat portion having a plane perpendicular to the axial direction of the roller; and a separation portion disposed outboard of the flat portion in a radial direction of the roller and having a surface located farther from the edge of the belt than the flat portion in the axial direction of the roller, wherein a transition from the flat portion to the separation portion has a continuous derivative.

9. An image forming apparatus comprising the roller unit according to claim 8.

10. The roller unit according to claim 8, wherein the surface of the separation portion includes an arc-shaped face.

* * * * *